United States Patent [19]

Liepert

[11] Patent Number: 5,064,184

[45] Date of Patent: Nov. 12, 1991

[54] FEEDER

[75] Inventor: Rudolf Liepert, Augsburg, Fed. Rep. of Germany

[73] Assignee: Georg Spiess GmbH, Gersthofen, Fed. Rep. of Germany

[21] Appl. No.: 500,774

[22] Filed: Mar. 27, 1990

[30] Foreign Application Priority Data

Apr. 14, 1989 [DE] Fed. Rep. of Germany ..... 3912241

[51] Int. Cl.[5] ..... B65H 3/08

[52] U.S. Cl. ..... 271/14; 271/93; 271/103

[58] Field of Search ..... 271/103, 91, 93, 11, 271/14

[56] References Cited

U.S. PATENT DOCUMENTS

| | | | |
|---|---|---|---|
| 2,341,521 | 2/1944 | Baker | 271/103 |
| 3,702,698 | 11/1972 | Schweber | 271/103 |
| 4,327,906 | 5/1982 | Frohlich | 271/103 |

FOREIGN PATENT DOCUMENTS

| | | |
|---|---|---|
| 2309013 | 7/1975 | Fed. Rep. of Germany . |
| 3912241 | 10/1990 | Fed. Rep. of Germany . |

*Primary Examiner*—Richard A. Schacher

*Attorney, Agent, or Firm*—Collard, Roe & Galgano

[57] ABSTRACT

In the context of a feeder, more especially a sheet feeder, comprising firstly a suction device which is placed over a stack of items to be fed, and has a separating devicre with at least one telescoping and preferably vertically reciprocable lifting suction holder, which when a sucker is covered over is able to be retracted against the action of a returning force by the action of vacuum present at such sucker, and secondly a conveyor device which has at least one reciprocating entraining sucking device and is adapted to have such item transferred to it from the separating device lifting such item from said stack, the invention seeks to achieve trouble-free operation and simplicity of operation by the provision of on the one hand at least one vacuum hold nozzle adjacent to overlapping surfaces of the telescopically engaging parts of each lifting suction holder and adapted to be turned on and off in accordance with the entraining suction motion in a manner independent of the sucker, and there is furthermore an abutting surface associated with the nozzle and resting against same in the retracted position.

9 Claims, 1 Drawing Sheet

FEEDER

BACKGROUND OF THE INVENTION

The invention relates to a feeder, more especially a sheet feeder, comprising firstly a suction device which is placed over a stack of items to be fed, and has a separating device with at least one telescoping and preferably vertically reciprocable lifting suction holder, which when a sucker is covered over is able to be retracted against the action of a returning force by the action of vacuum present at such sucker, and secondly a conveyor device which has at least one reciprocating entraining sucking device and is adapted to have such item transferred to it from the separating device lifting such item from said stack.

In a sheet feeder of this type it is only possible for the lifting suction holders, which as a rule are arranged in the vicinity of the rear edge of the stack, to take the first sheet (or other item) from the stack, when the entraining suction holders have moved the sheet or other item, which has previously been transferred, clear of the field of action of the lifting suction holders. The consequence of this is that the retracted part of the lifting suction holders has to dwell in such retracted position after transfer of the sheet for a certain length of time. Since for the transfer of a sheet the vacuum present at the sucker of the lifting suction holders has to be interrupted, it is necessary for the part of the suction holders which may be moved outwards to be held, against the force acting in the outward direction, in the retracted position. For this purpose use has so far been made of mechanical latches which are actuated by means of an actuating device secured to the machine frame. A disadvantage in this respect is not only the wear of the mechanical latches, but also the trouble of adjusting them.

In this connection it has in fact to be assumed that the lifting suction holders are able to be adjusted in height and in the case of such vertical adjustment having to be performed, there will also be the trouble of resetting the actuating device secured to the frame. Prior art feeders will thus be seen to be overly complex in design and not sufficiently simple to operate.

SHORT SUMMARY OF THE PRESENT INVENTION

Taking this state of the art as a starting point one object of the present invention is to improve upon a feeder of the initially mentioned type using simple and low-priced means to cause the dwell of the lifting suction holders in the retracted position without the use of mechanical latches.

In order to achieve this or other objects appearing from the present specification, claims and drawings, in the context of a feeder of the type mentioned hereinabove adjacent to overlapping surfaces of the telescopically engaging parts of each lifting suction holder there is on the one hand at least one vacuum hold nozzle adapted to be turned on and off in accordance with the entraining suction motion in a manner independent of the sucker, and on the other hand a means having an abutting surface associated with the nozzle and resting against same in the retracted position.

These measures ensure that the retractable and outwardly movable part of the lifting suction holders may be caused to dwell in the retracted position independently of the vacuum level at the respective associated sucker by means of vacuum present at the hold nozzle and that such part is only released when the vacuum present at the hold nozzle is turned off. Since the vacuum present at the hold nozzle may be turned on and off in a manner dependent on the motion of the entraining suction holders but without being dependent on the vacuum present at the sucker of the lifting suction holders, there is the advantage that the lifting suction holders may be caused to dwell in the retracted position until the entraining suction holders have entrained the previously transferred sheet or other item out of the range of the lifting suction holders without the transfer of the sheet being affected in any way by this and without having to have recourse to mechanical latches. Since the hold nozzle and the means with the abutting surface are connected with and, respectively, integrated in the respectively associated lifting suction holder, these elements are automatically adjusted concomitantly with any vertical adjustment of the lifting suction holders so that the operator does not have to go to the trouble of performing separate adjustment. A further advantage of the invention is that the system operates in a manner practically free of wear. Moreover, there is the advantage of rapid response. A further point is that the hold nozzle and the associated means with the abutting surface practically constitute a mechanical abutment so that there is no need for additional means for limiting the stroke size.

In accordance with a further feature the invention contemplates the provision of at least one entraining suction holder with a ramp means, by way of which a valve having an actuating plunger and provided on a vacuum line leading to the one or more hold nozzles, may be actuated. This feature involves the further beneficial effect that there is a direct control of the vacuum line by an entraining suction holder with the result that there is a sturdy and logical arrangement.

Further advantageous features and developments of the invention will be seen from the claims.

One working embodiment of the invention will now be described with reference to the drawing.

LIST OF THE SEVERAL FIGURES OF THE DRAWING

DETAILED DESCRIPTION OF THE INVENTION

Figure 1:
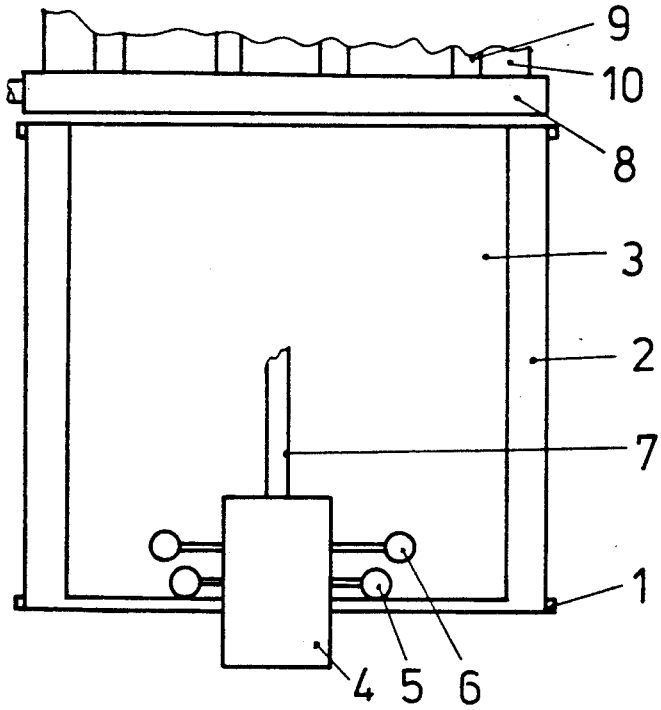
FIG. 1 is a diagrammatic plan view of a sheet feeder in accordance with the invention.

The sheet feeder shown in FIG. 1 comprises a stack table 2, carried by lifting chains 1, for receiving a stack 3 of sheets and a suction head 4 fitted over the sheet stack 3. The suction head is provided with lifting suction holders 5 forming a sheet separating device and a sheet conveying device formed by entraining suction holders 6. The lifting suction holders 5 and the entraining suction holders 6 are mounted on associated transverse girders of the suction head 4. For its part the suction head 4 is secured to a rail 7 extending in the length direction of the machine and it may be moved along this rail for adjustment to suit the respective size of sheet on the stack. In order to vertically set the suction head 4 to the level of the respective sheet stack the rail 7 is arranged so that it may be vertically adjusted.

In the vicinity of the front edge of the stack draw rolls 8 are provided, to which the sheets, respectively conveyed in a forward direction by the entraining suction holders 6, are transferred and which supply the sheets to a feed table 10 having conveyor belts 9. The details of design and the workings of such a sheet feeder as so far described with reference to the figures are generally known and do not require any further elucidation.

Figure 2:
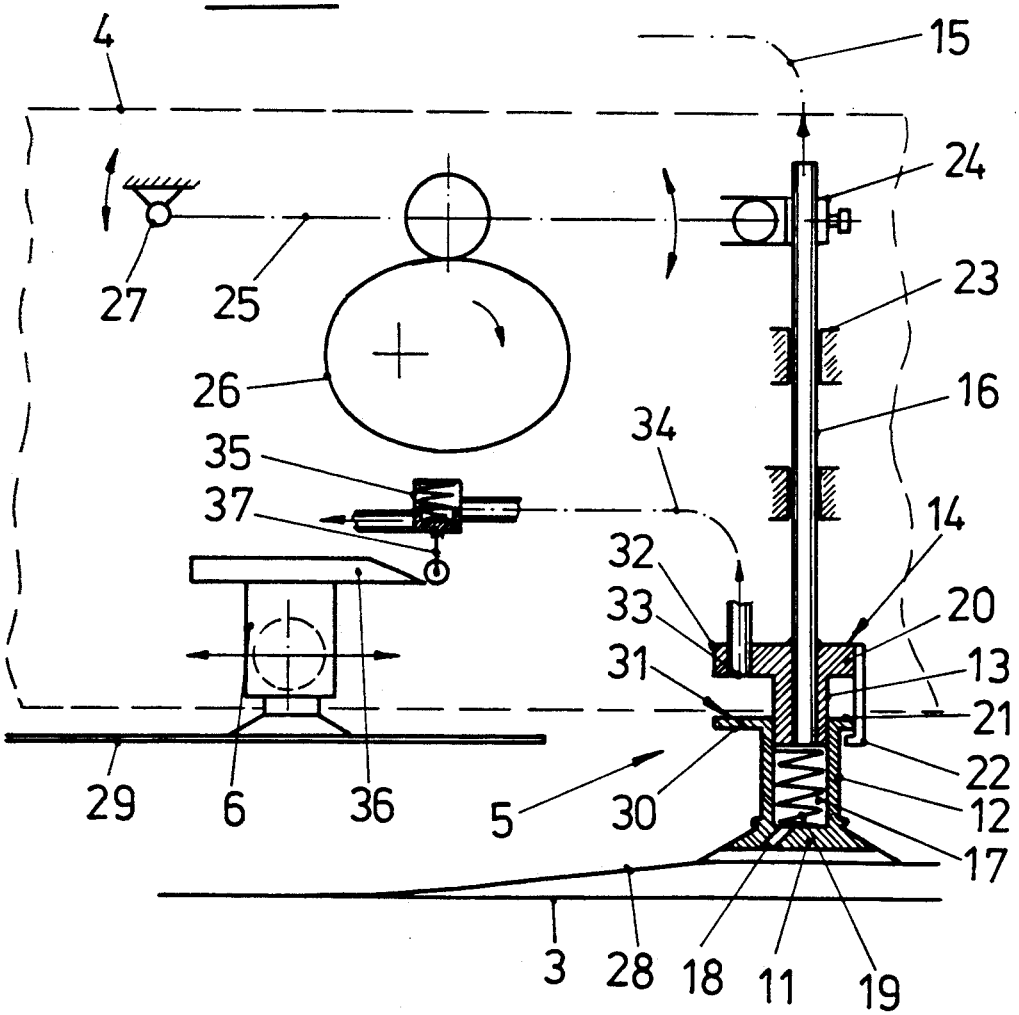
FIG. 2 is a diagrammatic elevation of the suction head of the feeder in accordance with the invention.

As may be seen from FIG. 2, the lifting suction holders 5 in each case consist of a sucker 11 and a suction tube 12 carrying same and which is slipped over a pin 13 of an associated bearing member 14, which is mounted on a tube 16 connected with a vacuum line 15 leading to a vacuum supply. In the illustrated form of the invention the bearing member 14 is for this purpose provided with a hole extending through its pins 13 or trunnions and the tube 16 is welded in place in such hole. As a result the bore of the suction tube 12 forming a cylindrical space 17 for the pin 13 and from which the suction nozzles 18 extend on the sucker side, is connected with the vacuum line 15. A helical compression spring 19 is mounted in the cylinder space 17 to urge the suction tube 12 downwards for the motion required in this direction. In order to limit this outward motion the bearing member 14 is provided with claws 22 extending downwards from a flange 20 (forming the upper limit of its pin 13) and fitting under a flange 21 provided on the upper end of the suction tube 12.

The tube 16 of the lifting suction holders 5 is arranged so as to be generally upright and is mounted in a vertically reciprocating manner on associated bearing blocks 23 fixed in relation to the suction head. The tubes 16 of the juxtaposed lifting suction holders are, as already noted, mounted on a common transverse bearer 24, which is acted upon by a rocking lever 25 in order to cause a working stroke, involving vertical reciprocation, of the lifting suction holders. The rocking lever 25 is actuated by an associated cam 26, which is driven in step with the sheet feed. The bearing block 27 of the rocking lever 25 may be adjusted in position, as is indicated by a double arrow in FIG. 2, for fine adjustment of the level of the lifting suction holders 5.

The purpose of the lifting suction holders 5 is, as may furthermore be seen from FIG. 2, to lift the respectively uppermost sheet 28 from the stack 3 of sheets 28, that is to say separate it from the stack. The sheet which is respectively cleared from the sheet stack 3 by the lifting suction holders 5 is transferred to the entraining suction holders 6 and moved away to the front, that is to say moved into a position in which it may be acted upon by the draw rolls 8, as is indicated in FIG. 2 with reference to the sheet 29. On transfer of a sheet to the entraining suction holders 6 the vacuum to the sucker 11 of the lifting suction holders 5 is turned off. However in order to prevent the suction tubes 12 from being moved out downwards under the effect of gravity and the tube-extending spring 19, something that might lead to a collision with the sheet transferred to the entraining suction holders 6, following the transfer of the sheet the suction tubes 12 are initially kept in their retracted position until the sheet transferred to the entraining suction holders 6 has been moved so far that its trailing edge is out of range of the lifting suction holders 6.

For this purpose the flange 21 of the suction tube 12 is provided with a wider part forming a radially projecting tag 30 whose upwardly turned flank is in the form of a flat abutting surface 31. The tag 30 on the suction tube side is overlapped by a radially projecting wider part of the flange 20, carrying the claws 22, of the bearing member 14. This wider part 32 bears a hold nozzle 33, which is connected with a vacuum supply by means of a movable vacuum line 34 or hose. In order to form the hold nozzle 33 it is possible for the wider part 32 to be simply provided with a through hole parallel to the axis of the suction holders so that the outlet port of the through hole forming the hold nozzle 33 may be covered over by the abutting surface 31. When a sheet 28 is transferred the suction tube 12 is moved into the upwardly retracted position owing the vacuum line 15 being put under vacuum. In this respect the retracting motion is limited by the abutting surface 31 of the tag 30 on the suction tube side running against the opposite abutting surface of the projection 32 on the bearing member so that the hold nozzle 33 is already covered over. By connecting the vacuum line 34 with vacuum the abutting surface 31 is subjected to a suction effect owing to the hold nozzle 33 and accordingly such suction force is also caused to act on the suction tube 12, which suction force overcomes the downwardly directed outward force due to gravity and the force of the outward drive spring 19 even after the vacuum in the vacuum line 15 has been switched off.

The hold nozzle 33 and the associated abutting surface 31 accordingly constitute a hold device, integrated in the respectively associated lifting suction holder 5, for retaining the suction tube 12 in the upward retracted setting. This integrated hold device is automatically adjusted each time the level of the lifting suction holders 5 is changed. Owing to its mobility the vacuum line 34 may readily keep up with any such adjustment.

The turning on and off of the vacuum in the vacuum line 34 leading to the hold nozzle 33 and connected with a vacuum source, takes place in accordance with the motion of the entraining suction holders 6 in such a manner that the hold nozzle 34 is supplied with vacuum as long as the entraining suction holders 6 are still insufficiently cleared from the lifting suction holders 5 in a downward direction. For this purpose there is a controlling valve 35 on the vacuum line 34 and such valve is opened before the entraining suction holders 6 have reached their rear terminal position and which is shut when the entraining suction holders 6 nave been sufficiently shifted in the forward direction. Since the entraining suction holders 6 are driven synchronously with the machine, the actuation of the control valve 35 may be caused by any suitable element driven in step with the machine. In the illustrated working example of the invention, the control valve 35 is operated directly by an entraining suction holder 6.

For this purpose the latter, as may also be seen from FIG. 2, is provided with a ramp plate 36, which operates a plunger 37 of the control valve 35. The ramp or cam plate 36 defines a separate initial range in order to provide for gentle operation.

Although a specific, preferred embodiment of the invention has been described, this selection of a special form of the invention is not to be understood to involve a limitation of the invention thereto. The invention may be advantageously applied to sheet feeders other than those, as above, designed for sheets of paper and the sheets may be sheets of sheet metal etc.

I claim:

1. A feeder comprising a suction device which is placed over a stack of items to be fed, and includes a separating device with at least one telescoping and vertically reciprocable lifting suction holder, having a sucker, which when the sucker is covered over is able to be retracted against the action of a returning force by the action of vacuum present at such sucker and said lifting suction holder having overlapping surfaces for telescopically engaging parts;

a conveyor device which has at least one reciprocating entraining sucking device and is adapted to have such item transferred to it from the separating device;

at least one hold nozzle which is placed adjacent to overlapping surfaces of the telescopically engaging parts of each lifting suction holder and is adapted to be put under vacuum varying with the movement of entraining suction holder, but in a manner independent of the sucker; and a means having an abutting surface associated with the nozzle and resting against same in the retracted position.

2. The feeder as recited in claim 1, wherein a vacuum line is associated with the hold nozzle and is able to be turned on and off directly by such an entraining suction holder.

3. The feeder as recited in claim 2, wherein at least one entraining suction holder comprises a ramp means, having a part defining an initial start phase, by means of which a control valve on such vacuum line may be operated by a plunger engaged by such ramp means.

4. The feeder as recited in claim 1, wherein when the entraining suction holder is moved to the rear the vacuum line is opened and is shut off when a reverse motion of the suction holder takes place forwards.

5. The feeder as recited in claim 1, wherein the abutting surface is formed on a suction tube and the hold nozzle is arranged on a bearing member of the lifting suction holder.

6. The feeder as recited in claim 5, wherein each lifting suction holder has a tag with said abutting surface thereon and projecting from the upper edge of a suction tube bearing the sucker, a nozzle holder being secured to a stationary bearing member of the lifting suction holder, carrying the associated suction nozzle and overlapping the said tag.

7. The feeder as recited in claim 6, wherein the tag is in the form of wider part of an upper edge flange of the suction tube.

8. The feeder as recited in claim 6, wherein the nozzle holder is in the form of a wider part of an edge flange of the bearing member, such edge flange having claws fitting under the edge flange of the suction tube.

9. The feeder as recited in claim 1, wherein the hold nozzle is in the form of a hole of the associated nozzle holder, such hole being parallel to the axis of the suction holder and connected to a vacuum line which is preferably movable as such.

* * * * *